United States Patent [19]

Lauer et al.

[11] 4,098,014

[45] Jul. 4, 1978

[54] COMBINATION BADGE AND FOLDER

[76] Inventors: Robert E. Lauer, 6201 E. Monterey Way, Scottsdale, Ariz. 85251; Leonard T. Symcox, 10618 N. 25th St., Phoenix, Ariz. 85028

[21] Appl. No.: 712,940

[22] Filed: Aug. 9, 1976

[51] Int. Cl.[2] ..... A44C 11/00

[52] U.S. Cl. ..... 40/1.5; 40/11 R

[58] Field of Search ..... 40/1.5, 1.6, 129 A, 40/359, 360, 11

[56] References Cited

U.S. PATENT DOCUMENTS

| | | | |
|---|---|---|---|
| 507,036 | 10/1893 | Perry | 40/1.5 |
| 1,481,120 | 1/1924 | Brombosz | 40/155 |
| 1,569,443 | 1/1926 | Weed | 40/1.5 |
| 2,341,773 | 2/1944 | Hanson | 40/1.5 |
| 3,500,568 | 3/1970 | Hushek | 40/1.5 |

FOREIGN PATENT DOCUMENTS

| | | | |
|---|---|---|---|
| 1,532,797 | 6/1968 | France | 40/359 |
| 1,389,634 | 4/1975 | United Kingdom | 40/359 |

*Primary Examiner*—Louis G. Mancene
*Assistant Examiner*—Wenceslao J. Contreras
*Attorney, Agent, or Firm*—Gregory J. Nelson

[57] ABSTRACT

As an article of manufacture a combination identification badge and information folder is disclosed. The article has a front and rear panel which are retained in juxtaposition by a removable clip. The clip also serves to secure informational material between the panels. The rear panel carries a pin for securing the badge to a garment. Indicia such as wearer identification, athletic insignia or the like are viewable on the front panel.

1 Claim, 11 Drawing Figures

COMBINATION BADGE AND FOLDER

The present invention relates to an article of manufacture and more particularly relates to a combination identification badge information folder to be worn on a garment. More particularly, the present invention relates to an item having the general appearance of a badge carrying appropriate indicia or insignia such as the emblem of a school athletic team and enclosing appropriate information such as statistical information relative to the performance of the particular athletic team.

It is a commonly known fact that supporters or boosters of particular athletic teams often wear emblems, pins or other novelty items which bear the insignia or emblem of the particular team.

It is also known that athletic fans are an avid breed who follow in detail the statistics of various teams and team players indicative of the performance of the team and the individuals. The statistics relative to performance often become the subject of great and extended debate on the part of athletic fans. For example, the batting average of a particular baseball player or the yardage gained by a particular running back in football in previous games often comes into controversial discussion. Therefore, such fans also often follow these statistics as printed in the newspapers or sports magazines and other periodicals with great interest often committing these detailed statistics to memory.

Similarly, attendees at conventions are generally issued a packet of material including an identification badge and a separate schedule of events and functions. These schedules are often lost or misplaced.

Briefly, the present invention provides an article of manufacture in the form of a novelty item which is a combination badge and envelope or folder for containing information. The article consists of an outer cover or envelope which in one embodiment is foldable along a medial line to form a folder having a front and rear panel. The upper edges of the folder are joined together by a releasable clip. The outer surface of the rear panel carries an appropriate pin so that the entire folder can be fastened to a garment. The front panel carries appropriate printed indicia such as an emblem or school insignia or wearer identification. Other information such as information relative to a particular athletic team can be inserted within the folder and retained in place by the clip. The folder can be constructed of heavy paper stock or other materials such as clear plastic. In another embodiment, the front and rear cover of the item are separate and are joined at a central location by insertion of a pin through an appropriate aperture in the front and rear cover panel. The pin also serves to secure the item to the garment. Statistical information is similarly printed on sheets having central perforations so that the paper can be secured between the covers with the pin inserted in the apertures.

A more complete description of the present invention will become apparent from the following description, claims and drawings in which:

Figure 1:
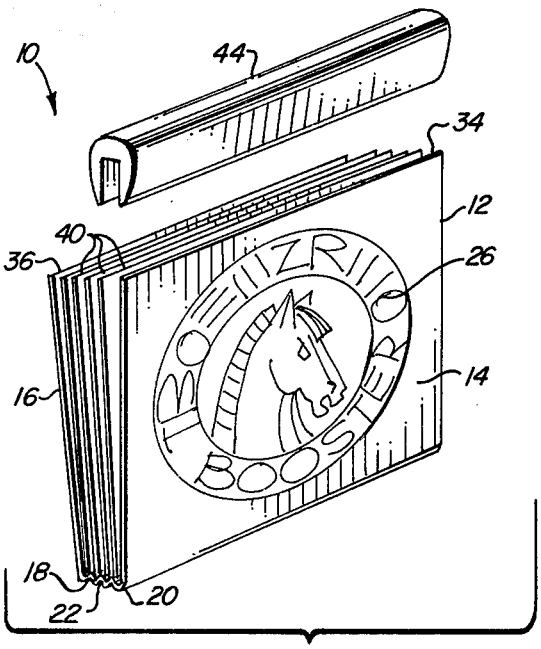
FIG. 1 is a front perspective view of one embodiment of the article of the present invention in a folded position with the clip partially engaged.
Figure 2:
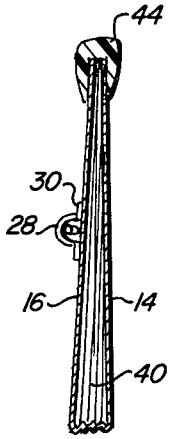
FIG. 2 is a vertical sectional view of the article shown in FIG. 1.
Figure 3:
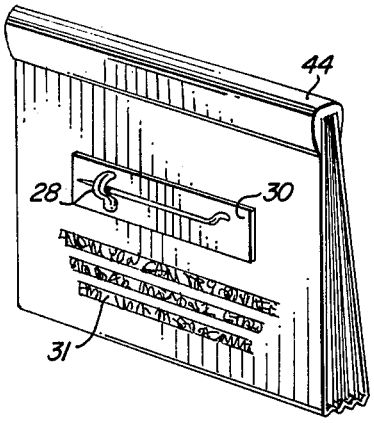
FIG. 3 is a rear perspective view of the article shown in FIG. 1.

Turning now to the drawings, particularly FIGS. 1 to 3, a preferred form of the novelty item of the present invention juxtaposition designated by the numeral 10. The item 10 includes a folder 12 having a front panel 14 and a rear panel 16 preferably formed from a single rectangular sheet of stock at transverse fold lines 18 and 20. Fold lines 18 and 20 are preferably spaced apart so that when the folder is assembled as shown in FIG. 1, the panels 14 and 16 are spaced apart to accommodate insertion of paper. An expandable section 22 may also be provided extending transversely intermediate fold lines 18 and 20. When assembled, cover panel 14 is folded in a position in juxtapositon relative to rear panel 16. The outer surface of panel 14 is printed with appropriate indicia 26. An athletic insignia is shown as being representative. Of course, any indicia or insignia representative of an athletic team or other organization could be printed on the front of panel 14.

Secured to the rear side of rear panel 16 is a clasp or pin 28 for securing the item 10 to a garment of the user. The clasp or pin 28 may be a conventional type of safety pin as shown secured to the rear cover by adhesive tab 30 or by engagement with a rear cover through apertures provided for this purpose. Preferably the rear panel is also provided with printed information 31 which typically would be the schedule of the athletic team. Appropriate commercial advertising such as a company logo could also be placed on the rear panel.

With the article 10 in the closed position as seen in FIG. 1 and 2, the upper transverse edges 34 and 36 of the front and rear panels are in juxtaposition. Appropriate informational sheets or pages 40 may be inserted between the panels. Preferably sheets 40 bear information of interest to the wearer of the badge such as team statistics or statistics relative to individual players on the team. The sheets 40 are preferably of a size and shape conforming to the size and shape of the front and rear panels 14 and 16. Sheets 40 are inserted between the front and rear panels and due to the spacing between the front and rear panels a number of sheets 40 can be accommodated between the panels. A clip 44 which is generally U-shaped in cross section is slidably engageable along the upper edge of the front and rear panels. Clip 44 serves to secure the front and rear panels together in a closed position tightly securing information sheets 40 between the panels. Thus, in the closed position the article 10 is unitary to be worn on the garment of a fan displaying the school or team insignia in support of the particular team. The indicia 31 on the rear cover provides information such as team schedules for the user. The enclosed sheets 40 provide more detailed information for the fan.

It is within the scope of this invention to provide for periodic updating of the statistic sheet 40. For example, the statistic sheets could be periodically printed in a newspaper or magazine and cut out by the fan and appropriately inserted between the panels 14 and 16. Thus, the fan would have a cumulative set of statistic sheets covering a selected period for the team. Another way of providing periodic updating of sheets 40, would be to distribute sheets 40 as tear sheets through various advertisers such as sporting good stores, taverns and the like. This would require the fan to go to a store to pick up the current statistic sheet 40 for his badge and would serve as a promotional item to attract customers to particular advertiser's establishments.

Figure 4:
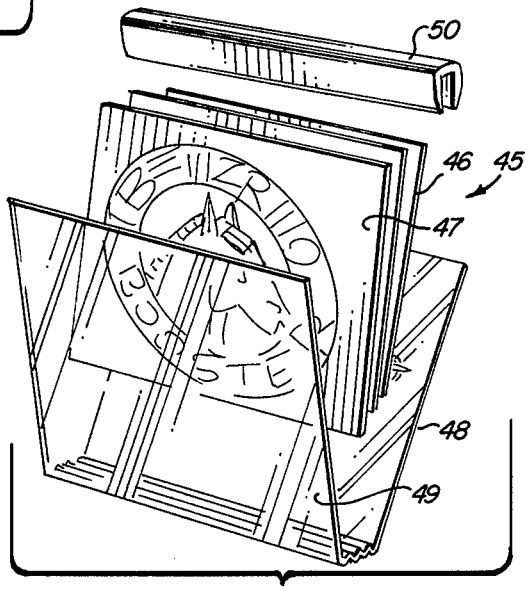
FIG. 4 is an exploded, perspective view of another form of the present invention.

The embodiment 45 shown in FIG. 4 is substantially the same as that described and shown with reference to FIGS. 1 to 3. The present embodiment comprises a combination badge and folder having front and rear panel 49 and 48, respectively. A clip 50 secures informational sheets or pages 46 and 47 between the panels. The panels 48 and 49 are fabricated from a transparent material such as clear styrene or acetate or similar materials. The front page or sheet 47 carries appropriate indicia which is viewable through panel 49 when the article is worn as a badge.

Figure 5:
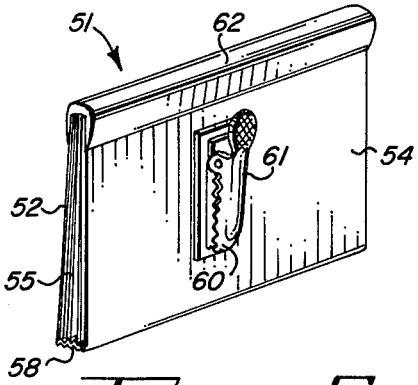
FIG. 5 is a rear view of the embodiment of the invention shown in FIG. 4.

FIG. 5 illustrates another embodiment of the present invention which is generally designated by the numeral 51 and again includes a front and rear panels 52 and 54, respectively, joined along their lower edges at expandable section 58. Informational material 55 is contained between the panels 52 and 54. The upper edges of panels 52 and 54 are secured together by an elongate, slidable clip 62. In the respects described above, the badge of this embodiment is substantially the same as has been described with reference to FIGS. 1 through 4. The rear panel 54 carries a clip 60 of the "alligator" type having a spring biased, serrated member 61 for gripping or engaging the garment of the user. Similarly a "bulldog" type clip may be used.

Figure 6:
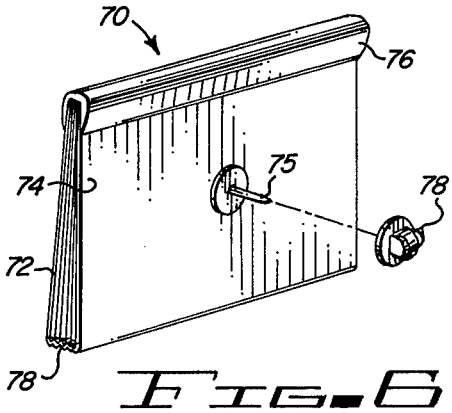
FIG. 6 is a rear perspective view showing still another form of the present invention.

FIG. 6 illustrates another embodiment of the present invention generally designated by the numeral 70. Again the badge is provided with overlying front and rear panels 72 and 74, respectively. The panels are joined along the bottom expandable edge 78. An elongate, slidable clip 76 engages the upper edges of the front and rear panels to secure them together and informational material between the panels. Clip 76 is generally U-shaped in cross section. The rear panel 74 carries a rearwardly projecting pin 75 at a central location. Pin 75 is adapted to penetrate or extend through the garment of the user. A cooperating clutch retainer 78 is adapted to engage the end of pin 75 on the side of the garment opposite the article to secure the article in place.

Figure 7:
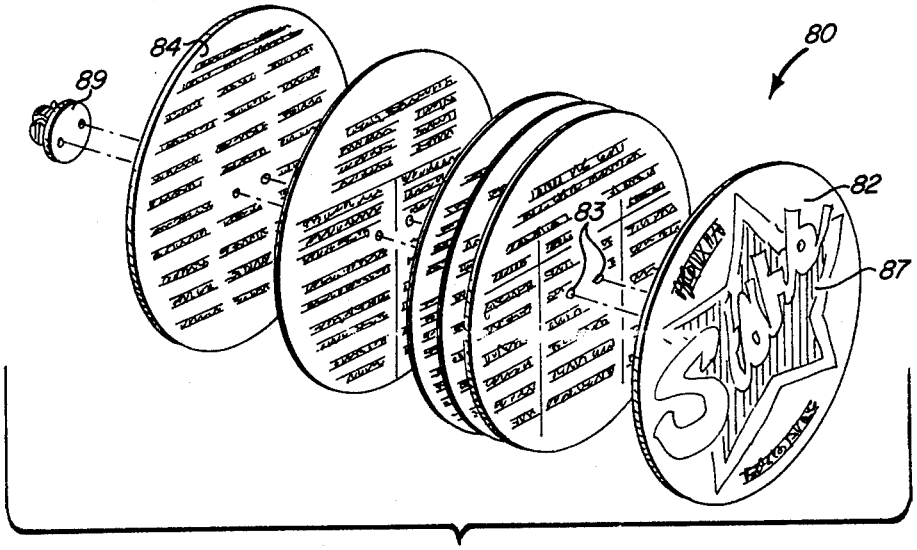
FIG. 7 is an exploded view illustrating another embodiment of the present invention.
Figure 8:
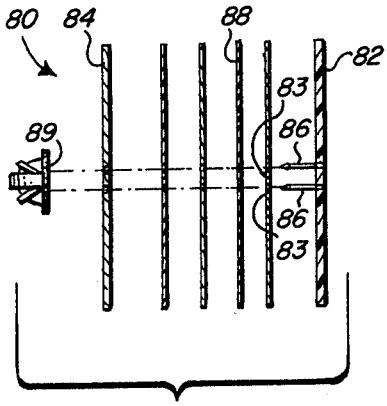
FIG. 8 is a top sectional view of the embodiment of FIG. 7.

FIGS. 7 and 8 disclose still another embodiment of the present invention generally designated by the numeral 80. In this embodiment the article includes a front panel 82 and a rear panel 84 of substantially the same size which are shown as circular but may be any appropriate shape. The front and rear panels 82 and 84 may be constructed of any appropriate material such as plastic, cardboard or heavy paper stock. Appropriate printed indicia 87 may be provided on the surfaces of the panels 82 and 84. A pin having a pair of prongs 86 extends rearwardly from front panel 82 at a central location. Informational sheets 88 are similarly circular and adapted to be interposed between panels 82 and 84. Central apertures 83 are provided in each of the informational sheets so that when the badge is assembled as shown in FIG. 8, prongs 86 will project through apertures 83 and also extend through the back of panel 84. In this way, sheets 88 are maintained against rotational movement and are properly aligned. Prongs 86 can be inserted through a portion of the wearer's garment and secured in place by a clutch-type retainer 89.

Figure 9:
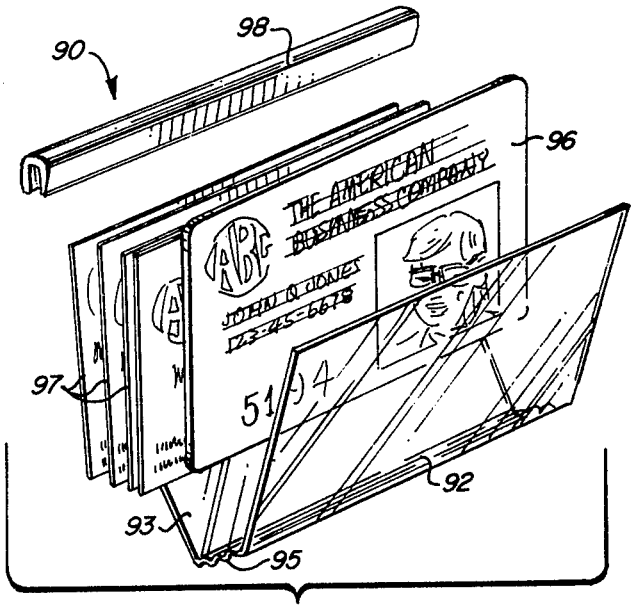
FIG. 9 is an exploded perspective view of still another embodiment of the invention which is adapted for identification purposes.
Figure 10:
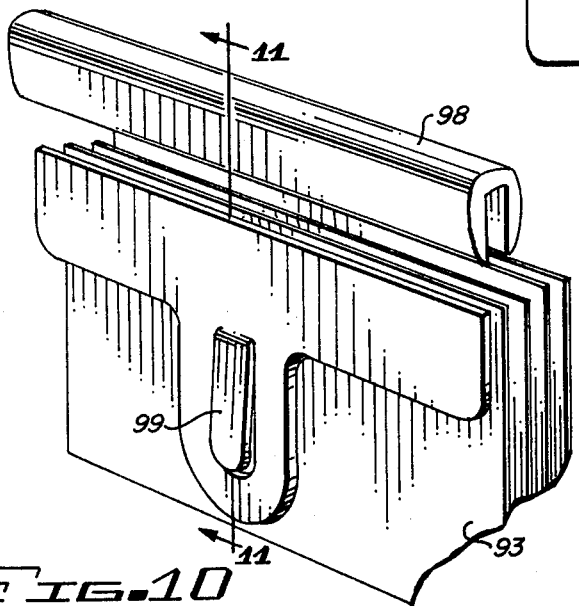
FIG. 10 is a rear perspective view of the combination badge and folder of FIG. 9.
Figure 11:
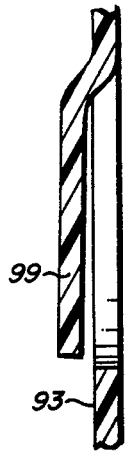
FIG. 11 is a sectional view taken along lines 11—11 of FIG. 10.

Another embodiment of the present invention is shown in FIGS. 9 to 11 and is generally designated by the numeral 90. The badge 90 includes generally rectangular front and rear panels 92 and 93, respectively. The panels are again joined along their lower edge at transverse expandable section 95. Preferably, the panels 92 and 93 and expandable section 95 are constructed from a single piece of stock of transparent material such as clear plastic. The article 90 is particularly suited for use by employees or conventioneers. An informational card 96 is placed immediately adjacent front panel 92. Card 96 carries appropriate information such as wearer identification or other pertinent information. This card may be a conventional laminated card often issued by companies to employees. This information is clearly visible through transparent or clear panel 92. Additional material 97 for the use of the wearer is inserted between rear panel 94 and informational card 96. Material 97 is shown as employee business cards which are readily accessible to the wearer for distribution. An elongate clip 98 secures the assembly together.

As best seen in FIGS. 10 and 11, rear panel 93 is molded or stamped having an integral tongue or tab 99 which can be engaged over the upper edge of a pocket of a garment.

The article shown in FIGS. 9 through 11 is also particularly useful by individuals attending events such as conventions. The elements of the article including the clip 98 and the body including the front and rear panels 92 and 93 can be provided in bulk, and be common for all users. A personalized identification card 96 can then be prepared for each individual attendee giving such information as required typically including the name of the individual and perhaps a picture or other indicia such as a company name. In addition, additional information for the use of the wearer can be provided on cards 97. Information may be simply in the form of the individual's business card or include additional information. For example, a schedule of events at a particular function could be printed and inserted for the use of the wearer. This would enable a folder and badge to serve a useful purpose of identifying the individual as an authorized representative or attendee and provide that individual with a complete schedule of events which would be carried with the individual at all times.

Thus, it will be seen that the present invention provides a unique combination badge and folder which serves the highly useful purposes of identification and as a receptacle for information quickly available to the wearer. The badge may be used as a novelty such as a booster pin for athletic fans bearing a team or school insignia and including appropriate statistical information or for employees, conventioneers and others for identification and convenient receipt of other materials. The informational materials can be periodically updated as required.

It will be obvious to those skilled in the art to make various changes, modifications and alterations to the embodiments herein chosen for purposes of illustration.

To the extent that these changes, modifications and alterations do not depart from the spirit and scope of the appended claims, they are intended to be encompassed therein.

We claim:

1. As an article of manufacture a combination identification badge and information folder, said article comprising:

(a) a front panel of transparent material having an edge portion;

(b) a rear panel having an edge portion said front panel and said rear panel being joined along said respective edge portions at an expandable section;

(c) removable retaining means securing said front and rear panels together along said edge portions at a location spaced apart from said expandable section;

(d) an information receiving section defined between said front and rear panels, said information receiving section adapted to receive and retain informational materials in place between said and secured therein by said removable retaining means whereby materials may be periodically inserted and removed in said information receiving section;

(e) said removable retaining means comprising a clip having a generally U-shaped cross section and including an elongate channel for receiving the edge of said front and rear panels and said informational materials therein, and (f) means for securing said article to the garment of the wearer.

* * * * *